US010094201B2

(12) United States Patent
Barry

(10) Patent No.: US 10,094,201 B2
(45) Date of Patent: Oct. 9, 2018

(54) CHEMICAL INJECTION TO INCREASE PRODUCTION FROM GAS WELLS

(71) Applicant: ABB Schweiz AG, Zurich (CH)

(72) Inventor: David Walter Barry, Bartlesville, OK (US)

(73) Assignee: ABB Schweiz AG, Baden (CH)

( * ) Notice: Subject to any disclaimer, the term of this patent is extended or adjusted under 35 U.S.C. 154(b) by 17 days.

(21) Appl. No.: 14/679,061

(22) Filed: Apr. 6, 2015

(65) Prior Publication Data

US 2015/0285046 A1 Oct. 8, 2015

Related U.S. Application Data

(60) Provisional application No. 61/976,071, filed on Apr. 7, 2014.

(51) Int. Cl.
*E21B 37/06* (2006.01)
*E21B 33/068* (2006.01)

(52) U.S. Cl.
CPC ..... *E21B 37/06* (2013.01); *E21B 33/068* (2013.01)

(58) Field of Classification Search
CPC ..... E21B 37/06
See application file for complete search history.

(56) References Cited

U.S. PATENT DOCUMENTS

2006/0096760 A1* 5/2006 Ohmer ..... E21B 43/121 166/304
2007/0284110 A1* 12/2007 Harris ..... E21B 43/12 166/310
2008/0099199 A1* 5/2008 Ayres ..... E21B 33/068 166/263
2008/0179063 A1* 7/2008 Smith ..... E21B 43/122 166/335
2008/0262737 A1* 10/2008 Thigpen ..... E21B 43/00 702/9
2011/0005765 A1* 1/2011 Cumming ..... E21B 41/04 166/344
2011/0024130 A1* 2/2011 Barry ..... E21B 43/121 166/372
2012/0322693 A1* 12/2012 Lachance ..... C09K 8/52 507/90
2013/0153231 A1* 6/2013 Ayres ..... G05D 7/0635 166/305.1

* cited by examiner

*Primary Examiner* — Angela M DiTrani
*Assistant Examiner* — Andrew Sue-Ako
(74) *Attorney, Agent, or Firm* — Taft Stettinius & Hollister LLP

(57) ABSTRACT

There is described a chemical injection system for a natural gas well. An instrument monitors the production of gas from the well and the flow of chemicals injected into the well. The instrument controls the on and off time of a chemical injection pump that is attached to a chemical injection tank. The control is based for certain chemicals such as a surfactant on the gas flow rate in the production piping. The user of the system inserts in the instrument the setpoints associated with the well's flow rate. These setpoints determine for a given flow rate the on time for the chemical injection pump. Other chemicals can also be injected into the well using the system and the injection for those chemicals may be based on other criteria such as temperature, water rate, oil rate or pipeline flow rate.

15 Claims, 4 Drawing Sheets

| Chemical | Injection Based On | Control Type |
|---|---|---|
| Surfactant | Gas Rate | Falling |
| Methanol | Temperature | Falling |
| H2S Scavenger | Gas Rate | Rising |
| Corrosion Inhibitors | Gas Rate | Rising |
| Scale Inhibitors | Water Rate | Rising |
| Paraffin Inhibitors | Oil Rate | Rising |
| Drag Reducing Agent | Flow Rate | Rising |

| # | Flowrate | Pump On Time |
|---|---|---|
| 1 | => 500 | 0 sec |
| 2 | => 475 | 2 |
| 3 | => 450 | 4 |
| 4 | => 425 | 6 |
| 5 | => 400 | 8 |
| 6 | => 375 | 10 |
| 7 | => 350 | 12 |
| 8 | => 325 | 14 |
| 9 | => 300 | 16 |
| 10 | => 275 | 18 |

| Chemical | Injection Based On | Control Type |
|---|---|---|
| Surfactant | Gas Rate | Falling |
| Methanol | Temperature | Falling |
| H2S Scavenger | Gas Rate | Rising |
| Corrosion Inhibitors | Gas Rate | Rising |
| Scale Inhibitors | Water Rate | Rising |
| Paraffin Inhibitors | Oil Rate | Rising |
| Drag Reducing Agent | Flow Rate | Rising |

Fig. 4

CHEMICAL INJECTION TO INCREASE PRODUCTION FROM GAS WELLS

FIELD OF THE INVENTION

This invention relates to fossil fuel wells and more particularly to the injection of a chemical foamer into the well to promote gas flow from the well.

DESCRIPTION OF THE PRIOR ART

Fossil fuel wells are generally limited in their production of natural gas due to naturally occurring fluids such as water that restrict the gas flow by accumulating in the production tubing of the well.

Chemical foamers are injected into a gas well to increase gas production from the well. The foamers are surfactants that are specially designed to regain or increase gas production in a maturing gas well. The foamer builds wet foam in the presence of condensate in the well and thus increases the liquids production of the well and thus the well's gas production.

Other chemicals such as methanol, a H2S scavenger, corrosion inhibitors, scale inhibitors and paraffin inhibitors may also be injected into a gas well.

SUMMARY OF THE INVENTION

A system for injecting a chemical into a natural gas well has:

a tank holding the chemical to be injected into the well;

an injection pump attached to the tank and the well, the pump on when injecting the chemical into the well; and an instrument connected to the well to measure one or more parameters of the well indicative of flow from the well, the instrument controlling the injection pump on time period and off time period based on a selected one of the one more well parameters indicative of flow from the well measured by the instrument and a predetermined criteria associated with the selected one measured well parameter.

DESCRIPTION OF THE DRAWING

FIG. 4 shows a chart of the chemical to be injected into the well, the basis for injecting the chemical and the type of control of the chemical injection pump.

DETAILED DESCRIPTION

Figure 1:
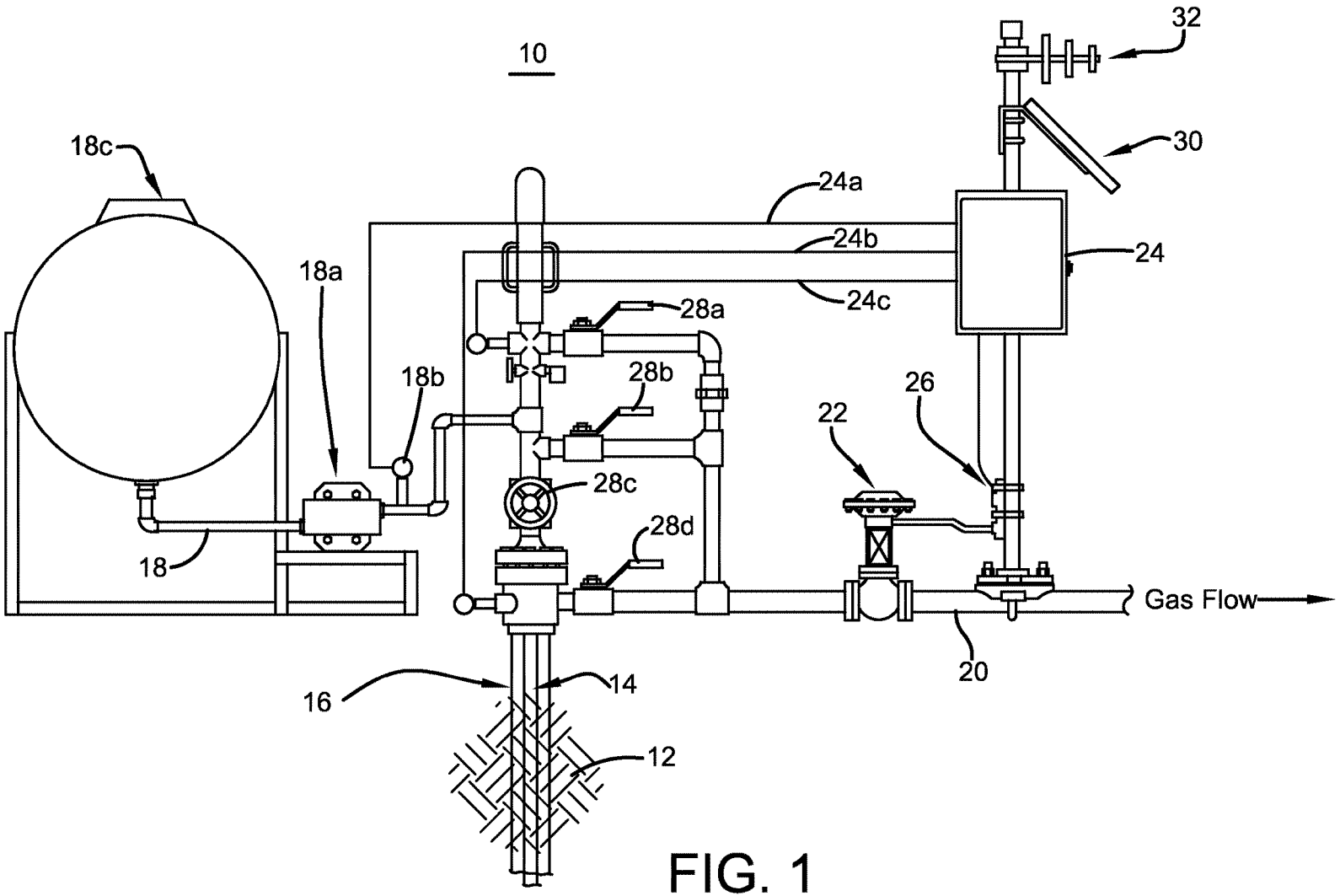
FIG. 1 shows a fossil fuel well system that uses the continuous chemical injection system described herein.

Referring now to FIG. 1, there is shown a fossil fuel well system 10 that uses the continuous chemical injection system described herein.

As shown in FIG. 1, a fossil fuel well 12 has a wellbore with production tubing 14, casing 16 and as is well known the area between the production tubing 14 and the casing 16 is the annulus. The well 12 has a chemical injection piping 18 that includes a chemical injection pump 18*a* and a pulse meter 18*b*. The piping 18 connects the pump 18*a* to a chemical injection tank 18*c*.

A production piping 20 has a pneumatic valve 22. The gas obtained from well 12 flows through piping 20.

An instrument 24, which is a computing device, is attached to piping 20 through a versa valve 26 that is connected to pneumatic valve 22. Versa valve 26 receives an open or close well signal from instrument 24 and pneumatically sends a signal to pneumatic valve 22. This connection of pneumatic valve 22 and versa valve 26 allows a command from instrument 24 to control the flow of gas in production piping 20.

The instrument 24 monitors the rate of production of natural gas from the well 12 and the flow of chemicals injected into well 12. Instrument 24 controls the chemical flow by sending a signal to chemical injection pump 18*a*. Instrument 24 can also monitor the amount of chemical flow by an input signal 24*a* from pulse meter 18*b*. Instrument 24 may for example be an ABB Totalflow RTU or flow computer. The versa-valve 26 is connected to the pneumatic valve 22. The other valves 28*a* to 28*d* are not used for chemical injection. They are used to divert or shut off flow of the natural gas in production piping 20.

The instrument 24 receives input signals 24*a*, described below, from pulse meter 18*b*. The instrument 24 also receives input signals 24*b* and 24*c* that are respectively representative of the pressures in the tubing 14 and casing 16. As described below in connection with FIGS. 2 and 3, a tubing pressure above a setpoint holds the last on time of the chemical injection pump 18*a* and a casing pressure above a setpoint prevents the pump 18*a* from running.

Instrument 24 performs the monitoring and control of the attached apparatus using the inputs and outputs described above. The chemical injection application is in instrument 24. As described above, the instrument 24 controls the on and off time of chemical injection pump 18*a*. This control is based on the rate of gas flow in the production piping 20. When the flow rate is above a certain rate the pump does not run. As the flow rate drops below the setpoint the pump 18*a* comes on for longer times in a one minute cycle. A solar panel 30 and a radio or wireless transmitter 32 are attached to the transmitter 24. The solar panel 30 provides electrical power for the operation of instrument 24.

Figure 2:
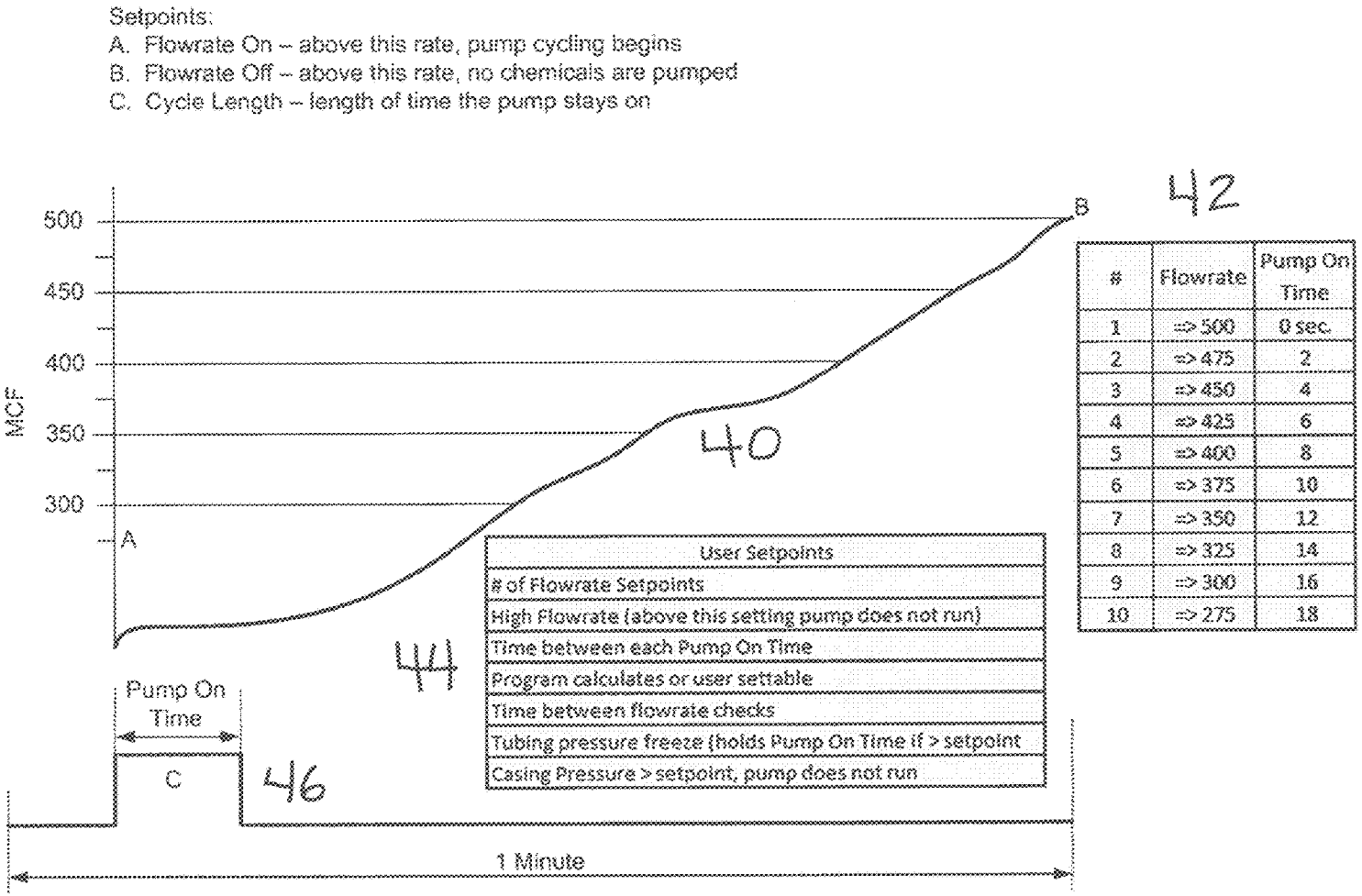
FIG. 2 shows a graph of one example of the flow rate of gas from the fossil fuel well, and the flow rate setpoints that determine how long the chemical pump will run in a one minute cycle.

Referring now to FIG. 2 there is shown a graph 40 of one example of the flow rate of the gas from well 12 in MCF versus time in a time span of one minute. As described in more detail below, the user of system 10 inserts in instrument 24 the setpoints associated with the flow rate of well 12. The entered flow rate setpoints determine for a given flow rate the on time for chemical injection pump 18*a*.

For example as shown in the table 42 on the right side of FIG. 2, when the entered flow rate setpoint is for a well flow rate of equal to or greater than 500 MCF, the pump 18*a* is not on. As shown in the chart 44 in the middle of FIG. 2, this entered flow rate setpoint is the high well flow rate that if exceeded does not result in the operation of pump 18*a*.

In contrast, if the well flow rate is above that for one of the entered setpoints that are below the 500 MCF setpoint, then the pump 18*a* will be turned on for the time period shown in the right hand column of table 42. For example, if the flow rate is 480 mcf, then the pump will run for two (2) seconds. The time that the pump 18*a* is turned on is determined by the user of system 10.

As shown in chart 44 the user also enters in instrument 24 if the program in instrument 24 determines the intermediate setpoints using the number of setpoints and the high and low flow rate setpoints or if the user enters into instrument 24 the rates for the setpoints and the pump run time for each setpoint. The time between flow rate checks by instrument 24 determines the flow rate that the pump run time will be based on. The tubing pressure freeze setpoint that is described above holds the last on time of the chemical injection pump 18*a* if the tubing pressure is greater than the user entered setpoint and the casing pressure setpoint that as described above if exceeded prevents pump 18*a* from running.

As shown by graph 40, if in this example the flow rate is above the flow rate identified on the Y axis by A of 275 MCF then the pump 18*a* is turned on and the pump 18*a* will stay on until the flow rate reaches the flow rate identified on the Y axis by B of 500 MCF. The pump 18*a* is then turned off and no chemicals are pumped into well 12.

FIG. 2 shows by graph 46 the number of seconds identified as C that the pump 18*a* is on in a minute cycle. The on time C depends on the well's flow rate and the setpoints chosen by the user of system 10.

Figure 3:
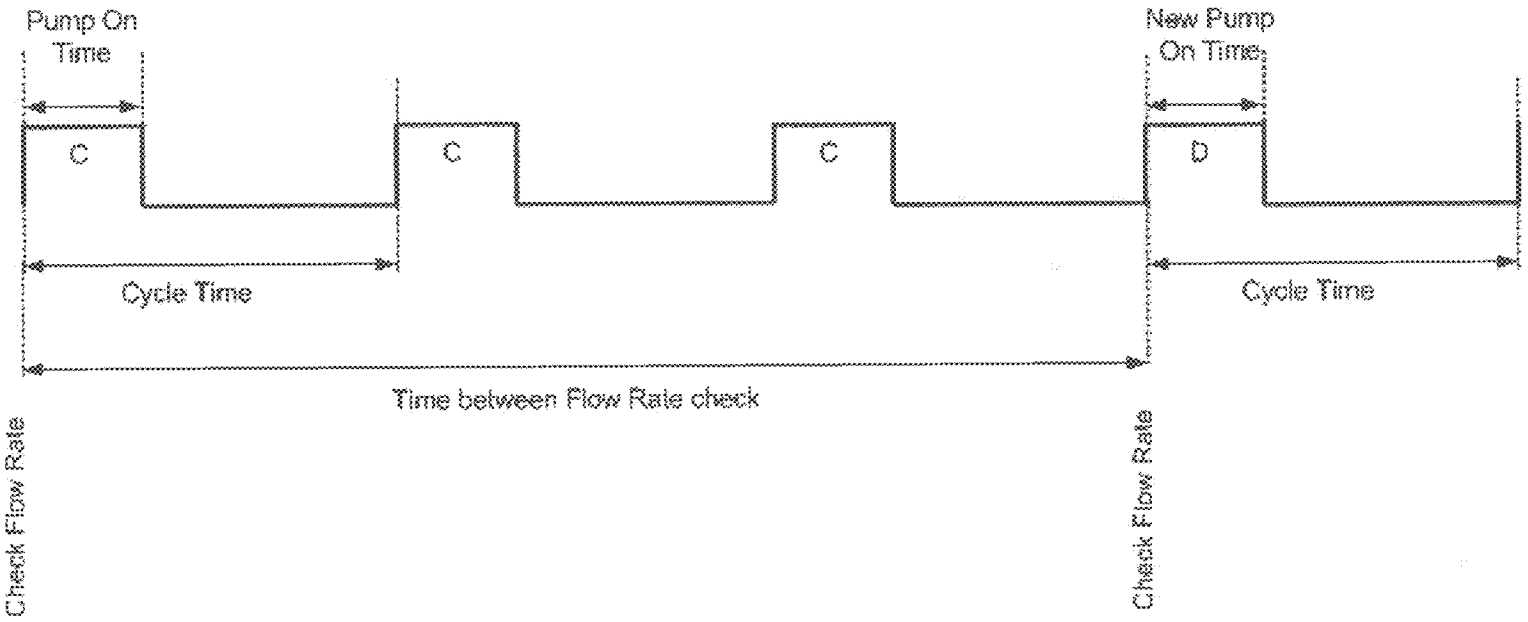
FIG. 3 shows an example of how often the flow rate is checked to determine the chemical pump run time.

Referring now to FIG. 3, there is shown an example of the pump on time C for three cycles of pump on time between two flow rate check commands. As shown in this example, after the second flow rate check command is executed by instrument 24 the pump on time becomes a new on time identified as D. As can be appreciated the user entered time between flow rate check commands (see 44 in FIG. 2) determines how many cycles of pump on time are the same before the pump on time may be changed as a result of a change in the well flow rate. Of course in this example the pump on time may remain the same as it was before the second flow rate check command is executed by instrument 24. Instead of taking a snapshot of the flow rate at the end of the "time between flow rate check", there is an option to take an average flow rate. The user can determine how long before the end to flow rate check time, to start the averaging of the flow rate.

In the continuous chemical injection system described above the chemical injected is a surfactant and the rate used to determine when the chemical is injected is based on the gas flow rate of the well. It should be appreciated that the injection system can be used with other chemicals that are injected into the well 12 as described below where the injection is based on a well parameter such as a rate, H2S or temperature.

Referring now to FIG. 4 there is a chart that shows the chemical to be injected, the well parameter used as the basis for turning on the injection pump to inject the chemical and the control type.

The first entry in the chart is for the surfactant injection based on the gas flow rate where the control type is designated as "falling". As can be appreciated from the description above for FIG. 2, when the control type is "falling", at any rate above the high setpoint, the pump does not run and as the flow rate drops the pump runs for the time as shown in table 42. The above also applies for the injection of methanol into well 12 where the temperature of the well is used to determine the on and off time for the methanol injection pump.

All of the other entries in the chart except for the last entry are for a "rising" control type of the gas well flow rate for chemicals such as H2S scavenger and corrosion inhibitors where the injection is based on gas flow rate, scale inhibitors where the injection is based on water flow rate and paraffin inhibitors where the injection is based on oil flow rate.

Also shown at the bottom of FIG. 4 is another "rising" control type where drag reducing agents are injected into a pipeline based on the pipeline flow rate. The technique described herein for controlled injection of chemicals into a gas well also applies to the controlled injection of drag reducing agents into the pipeline.

In a rising control type, the highest rate associated with the chemical to be injected would have the highest injection pump on time and if that rate is below the low setpoint then the pump is not on.

It should be appreciated that while not shown in the figures, there can be in instrument 24 a low flow rate setpoint to not have the chemical injection pump 18*a* run when the well 12 shuts in as there is no need to inject a chemical into the well when it is shut in.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A system for injecting a chemical into a gas production well comprising:

a tank holding said chemical to be injected into said gas production well;

an injection pump attached to said tank and said gas production well, said injection pump injecting said chemical into said gas production well; and an instrument connected to said gas production well, said instrument being configured to control an on-time period and an off-time period of said injection pump based on a selected one of one or more measured parameters with a falling control type, wherein said chemical to be injected into said gas production well is a surfactant, wherein said selected one of said one or more measured parameters is gas flow rate, wherein, with said falling control type, controlling injection of said surfactant is based on said gas flow rate.

2. The system of claim 1, wherein according to said falling control type, said injection pump is in said off-time period when said gas flow rate is equal to or greater than a predetermined flow rate for said injection pump off-time period.

3. The system of claim 2 wherein said instrument turns said injection pump on for a predetermined period of time when said gas flow rate is below said predetermined gas flow rate for said injection pump off-time period.

4. The system of claim 3, wherein said predetermined on-time period for said injection pump increases in relation to how much said gas flow rate is below said predetermined gas flow rate for said injection pump off-time period.

5. The system of claim 1 wherein said instrument has a command for checking said one or more measured parameters indicative of flow from said gas production well, said command executed when a predetermined interval of time has passed.

6. The system of claim 1 wherein said instrument executes a command to check rate of flow from said gas production well when said injection pump is cycled on for a predetermined period of time and when a predetermined number of executions of said cycles of said predetermined period of said injection pump on-time has occurred, said instrument one of providing said predetermined on-time period or modifying said predetermined injection pump on-time period to a different predetermined injection pump on-time period.

7. The system of claim 1 wherein said instrument executes a command to check rate of flow from said gas production well when said injection pump is cycled on for a predetermined period of time and when a predetermined number of executions of said cycles of said predetermined period of injection pump on-time has occurred said instrument takes an average of said flow rate over said predetermined period of time associated with said injection pump turning on and said occurrence of said predetermined number of executions of said cycles of said predetermined on-time period.

8. The system of claim 1, wherein said instrument is further configured to control an on-time period and an off-time period of said injection pump based on a rising control type, wherein for said rising control type (1) said chemical to be injected into said gas production well is selected from one of a H2S scavenger, corrosion inhibitors, scale inhibitors, paraffin inhibitors and drag reducing agents and (2) wherein said selected one of said one or more measured parameters is selected from one of gas flow rate, water flow rate, oil flow rate, and pipeline flow rate, wherein, with said rising control type, controlling injection of said H2S scavenger or corrosion inhibitors is based on said gas flow rate, wherein, with said rising control type, controlling injection of said scale inhibitors is based on said water flow rate, wherein, with said rising control type, controlling injection of said paraffin inhibitors is based on said oil flow rate, and wherein, with said rising control type, controlling injection of said drag reducing agents is based on said pipeline flow rate.

9. The system of claim 8 wherein according to said rising control type, said injection pump is off when said selected one measured parameter indicative of flow from said gas production well is below a predetermined flow rate for said injection pump off-time period.

10. The system of claim 9 wherein said injection pump is on for said on-time period when said selected one measured parameter is above said predetermined flow rate for said injection pump off-time period.

11. The system of claim 8 wherein when said chemical to be injected into said gas production well is selected from one of said H2S scavenger, corrosion inhibitors, scale inhibitors, paraffin inhibitors and drag reducing agents and said selected one measured parameter indicative of flow from said gas production well used in control of said injection pump is determined by which of one of said chemicals is selected for injection into said gas production well.

12. The system of claim 11, wherein said instrument is operable to:

store a plurality of predetermined set points corresponding to a different range of said one or more measured parameters indicative of flow from said gas production well, wherein the duration of at least one of said on-time period and said off-time period of operation of said injection pump is different for a plurality of said plurality of predetermined set points, and wherein said plurality of predetermined set points include a maximum set point corresponding to a predetermined maximum flow rate or a predetermined maximum temperature and a minimum set point corresponding to a predetermined minimum flow rate.

13. The system of claim 12 wherein according to said rising control type, said instrument is configured to turn said injection pump off when said selected one measured parameter indicative of flow from said gas production well is below a predetermined minimum set point of said plurality of predetermined set points, and said instrument is configured to turn said injection pump on for a predetermined on-time period when said selected one measured parameter is above said predetermined minimum set point and below a predetermined maximum set point of said plurality of predetermined set points.

14. The system of claim 1 wherein said instrument is operable to:

store a plurality of predetermined set points corresponding to a different range of said one or more measured parameters indicative of flow from said gas production well, wherein the duration of at least one of said on-time period and said off-time period of operation of said injection pump is different for a plurality of said plurality of predetermined set points, and wherein said plurality of predetermined set points include a maximum set point corresponding to a predetermined maximum flow rate or a predetermined maximum temperature and a minimum set point corresponding to a predetermined minimum flow rate.

15. The system of claim 14 wherein according to said falling control type, when said chemical to be injected into said gas production well is selected from one of said surfactant, said instrument is configured to turn said injection pump on for said on-time period when said gas flow rate is below said predetermined maximum set point, and wherein said on-time period for said injection pump for each of said plurality of predetermined set points below said maximum set point increases in relation to how much said gas flow rate is below said predetermined maximum gas flow rate.

* * * * *